US009611704B2

(12) United States Patent
Springett et al.

(10) Patent No.: US 9,611,704 B2
(45) Date of Patent: Apr. 4, 2017

(54) HANDS FREE GOOSENECK WITH ROTATING CARTRIDGE ASSEMBLIES

(71) Applicant: National Oilwell Varco, L.P., Houston, TX (US)

(72) Inventors: Frank Springett, Spring, TX (US); George Tisdale, Spring, TX (US); John Cannell, Houston, TX (US); Stephen B. Gauntt, Houston, TX (US); Matthew Taylor, Katy, TX (US)

(73) Assignee: National Oilwell Varco, L.P., Houston, TX (US)

( * ) Notice: Subject to any disclaimer, the term of this patent is extended or adjusted under 35 U.S.C. 154(b) by 377 days.

(21) Appl. No.: 14/031,723

(22) Filed: Sep. 19, 2013

(65) Prior Publication Data

US 2014/0083711 A1 Mar. 27, 2014

Related U.S. Application Data

(60) Provisional application No. 61/704,179, filed on Sep. 21, 2012.

(51) Int. Cl.

| | |
|---|---|
| ***E21B 43/01*** | (2006.01) |
| ***E21B 19/12*** | (2006.01) |
| ***E21B 17/08*** | (2006.01) |
| ***E21B 17/01*** | (2006.01) |
| ***E21B 19/00*** | (2006.01) |

(52) U.S. Cl.

CPC ..... *E21B 17/085* (2013.01); *E21B 17/01* (2013.01); *E21B 19/004* (2013.01)

(58) Field of Classification Search

USPC ..... 166/345, 351

See application file for complete search history.

(56) References Cited

U.S. PATENT DOCUMENTS

| | | | | |
|---|---|---|---|---|
| 4,403,658 A | | 9/1983 | Watkins | |
| 4,448,568 A | | 5/1984 | Gentry et al. | |
| 4,592,426 A | | 6/1986 | Neeley | |
| 4,712,620 A | * | 12/1987 | Lim et al. | 166/355 |
| 5,727,630 A | | 3/1998 | Brammer | |

(Continued)

FOREIGN PATENT DOCUMENTS

GB 1224309 3/1971

OTHER PUBLICATIONS

Search Report and Written Opinion dated Sep. 26, 2014 for International Application No. PCT/US2013/060631 (12 pgs.).

(Continued)

*Primary Examiner* — Matthew Buck
*Assistant Examiner* — Douglas S Wood
(74) *Attorney, Agent, or Firm* — Derek V. Forinash; Porter Hedges LLP

(57) ABSTRACT

A gooseneck assembly having a body disposed circumferentially about a portion of a riser string. A stab member is inwardly radially extendable relative to the body and engages a receptacle disposed on the riser string. A cartridge assembly engages the stab member and has a flexible hose coupling that is rotatable relative to a central axis of the stab member. The coupling is in fluid communication with the receptacle via the stab member. The assembly includes an actuator that is operable to rotate the flexible hose coupling relative to the central axis of the stab member.

20 Claims, 8 Drawing Sheets

(56) References Cited

U.S. PATENT DOCUMENTS

| | | | | |
|---|---|---|---|---|
| 7,571,772 | B2 * | 8/2009 | Reams | 166/367 |
| 2006/0219412 | A1 | 10/2006 | Yater | |
| 2010/0147528 | A1 | 6/2010 | Baugh | |
| 2012/0318517 | A1 * | 12/2012 | Christensen et al. | 166/345 |

OTHER PUBLICATIONS

International Preliminary Report on Patentability dated Mar. 24, 2015 for International Application No. PCT/US2013/060631 (9 pgs.).

* cited by examiner

HANDS FREE GOOSENECK WITH ROTATING CARTRIDGE ASSEMBLIES

CROSS-REFERENCE TO RELATED APPLICATIONS

This application claims priority to U.S. patent application Ser. No. 61/704,179, titled Hands Free Gooseneck with Rotating Cartridge Assemblies, which was filed Sep. 21, 2012. This priority application is hereby incorporated by reference in its entirety into the present application, to the extent that it is not inconsistent with the present application.

BACKGROUND

This disclosure relates generally to methods and apparatus for coupling a riser string to an offshore drilling rig. More specifically, this disclosure relates to methods and apparatus for coupling the auxiliary lines of a riser string to a drilling rig. Still more particularly, this disclosure relates to methods and apparatus that provide connections between the auxiliary lines of a riser that can be automatically repositioned so as to allow other equipment to be moved into and out of the moon pool of the offshore drilling rig.

Offshore drilling rigs utilize drilling risers as the conduit between the drilling equipment at the surface and drilling equipment mounted on the seafloor. The drilling riser is a tubular conduit that serves as an extension of the wellbore from the equipment on the wellhead at the seafloor to the floating drilling rig. Conventional drilling risers include a primary tubular conduit and a plurality of smaller, higher pressure auxiliary conduits that are externally mounted to the primary tubular and provide conduits for choke, kill, and auxiliary fluid communication with the subsea blowout preventers.

At the top of the riser string, these auxiliary conduits end in a terminal fitting that includes a plurality of goosenecks that connect to high pressure flexible hoses that are coupled to stationary piping on the drilling rig. The flexible hoses are necessary to compensate for the relative motion that occurs between the drilling rig and the riser. Conventionally, during riser assembly, the flexible hoses are manually connected to the gooseneck by rig personnel that are often suspended over the moon pool during this process.

Manufacturers have begun to offer gooseneck assemblies that can be connected to the auxiliary lines without manual intervention. These gooseneck assemblies can be coupled to the flexible hoses in a location away from the moon pool and can then be moved into position and coupled to the riser with minimum manual intervention. Once the gooseneck assembly is in position on the riser, the flexible hoses drape into the moon pool.

When other equipment, such as the blowout preventer stack, needs to be moved through or into the moon pool, the flexible hoses often have to be moved out of the way to clear a path through the moon pool area. Conventional methods for moving the flexible hoses include simply pushing the flexible hoses out of the way with the equipment or manually moving the flexible hoses using tugger lines and winches. Each of these methods has drawbacks that can result in damage to equipment and exposing personnel to potential hazards.

Thus, there is a continuing need in the art for methods and apparatus for facilitating the management of flexible hoses within the moon pool that overcome these and other limitations of the prior art.

BRIEF SUMMARY OF THE DISCLOSURE

A gooseneck assembly having a body disposed circumferentially about a portion of a riser string. A stab member is inwardly radially extendable relative to the body and engages a receptacle disposed on the riser string. A cartridge assembly engages the stab member and has a flexible hose coupling that is rotatable relative to a central axis of the stab member. The coupling is in fluid communication with the receptacle via the stab member. The assembly includes a actuator that is operable to rotate the flexible hose coupling relative to the central axis of the stab member.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
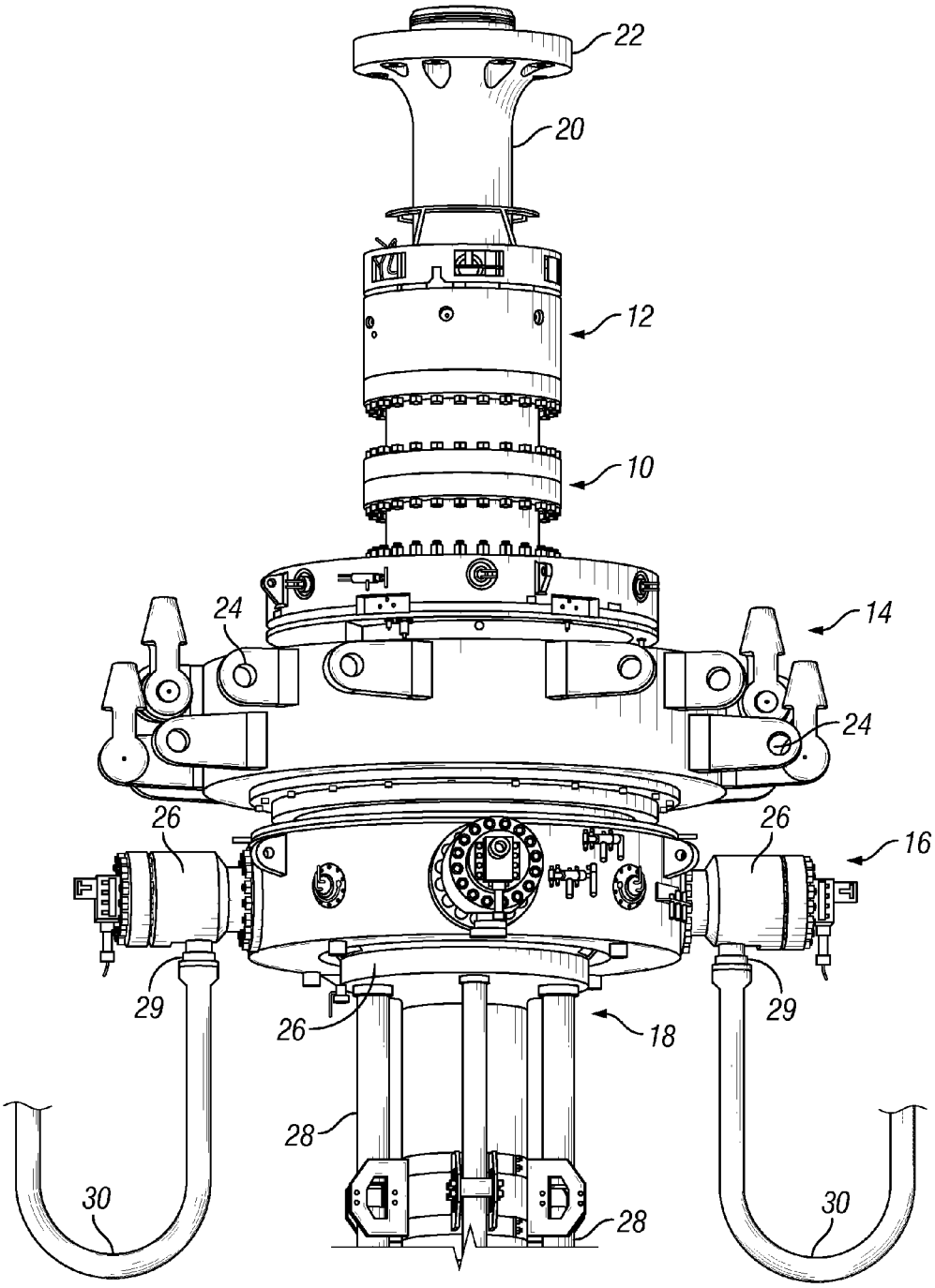
FIG. 1 is an elevation view of a riser termination assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a riser termination assembly 10 includes a telescopic joint 12, a tension ring 14, a hands free gooseneck assembly 16, and a riser termination joint 18. The upper end 20 of the telescopic joint 12 includes a flange 22 that couples to a diverter (not shown) or to other equipment mounted to the drilling rig. The tension ring 14 includes a plurality of connection points 24 that allow for cables from the rig's tensioning equipment to be coupled to the tension ring so that the riser is held in tension as the rig moves due to wave action or other forces. The hands free gooseneck assembly 16 is supported by the tension ring 14 and includes auxiliary line cartridge assemblies 26 that provide fluid communication with the riser choke, kill, and auxiliary lines 28 and a connection coupling for flexible hoses 30 that are coupled to stationary piping on the drilling rig.

Figure 2:
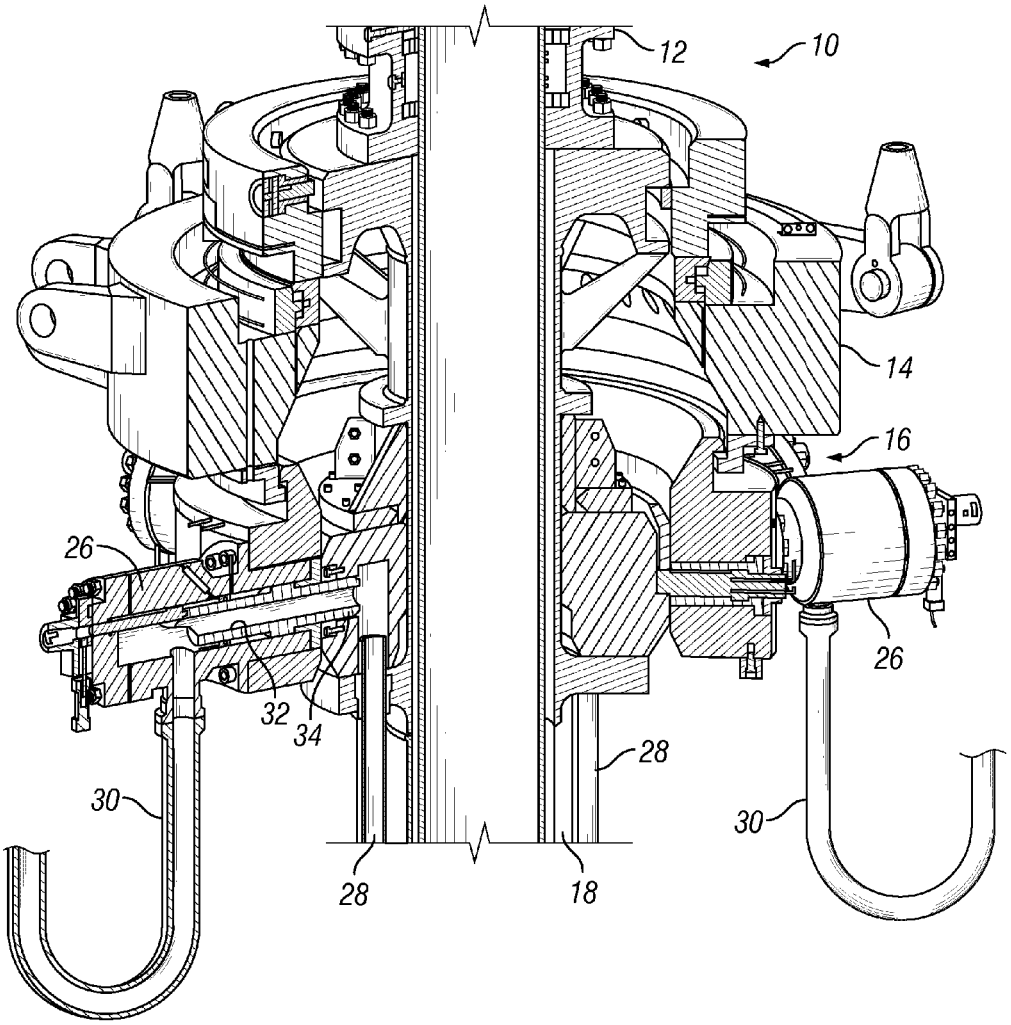
FIG. 2 is a partial sectional view of a riser termination assembly.

FIG. 2 illustrates a partial sectional view of the riser termination assembly 10 of FIG. 1. The cartridge assemblies 26 are mounted to the hands free gooseneck assembly 16 include stabs 32 project radially inward from the gooseneck assembly 16 and selectively engage receptacles 34 formed in the riser termination joint 18. The receptacles 34 are in fluid communication with the riser choke, kill, and auxiliary lines 28. Once engaged with the receptacles 34, the stabs 32 provide fluid communication between the riser lines 28 and the flexible hoses 30, which are coupled to the drilling rig.

In operation, the riser termination assembly 10 is disposed within the moon pool of the drilling rig. As the rig moves, the upper end 20 of the telescopic joint 12 moves with the rig and the tension ring 14, hands free gooseneck assembly 16, riser termination joint 18, and flexible hoses 30 move up and down relative to the rig. The flexible hoses 30 extend vertically downward from the cartridge assemblies 26 and then curve upward to their respective connections to the drilling rig. This "draping" of the flexible hoses 30 allows the tension ring 14 and hands free gooseneck assembly 16 to move relative to the drilling rig during operations.

Figure 3A:
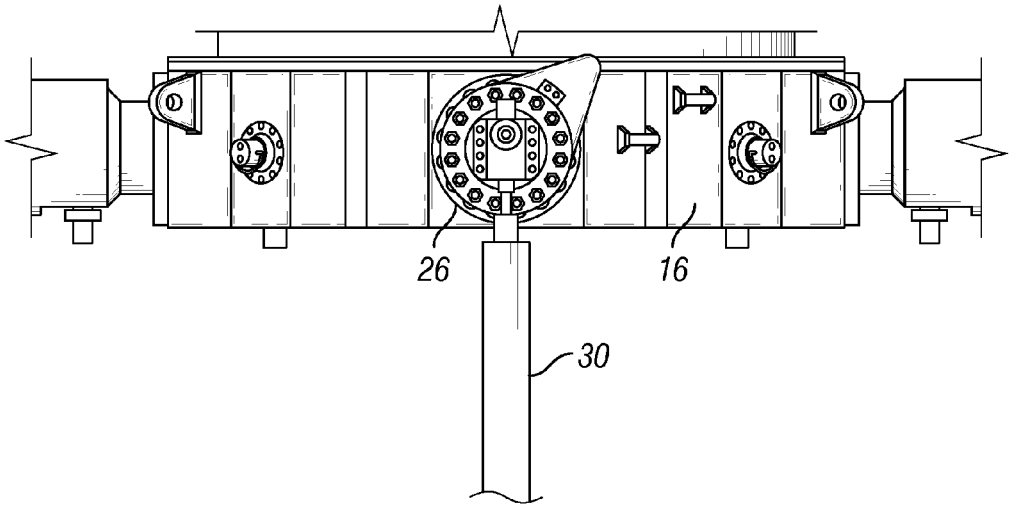
FIGS. 3A and 3B are partial elevation views of a hands free gooseneck assembly having a rotatable coupling.
Figure 3B:
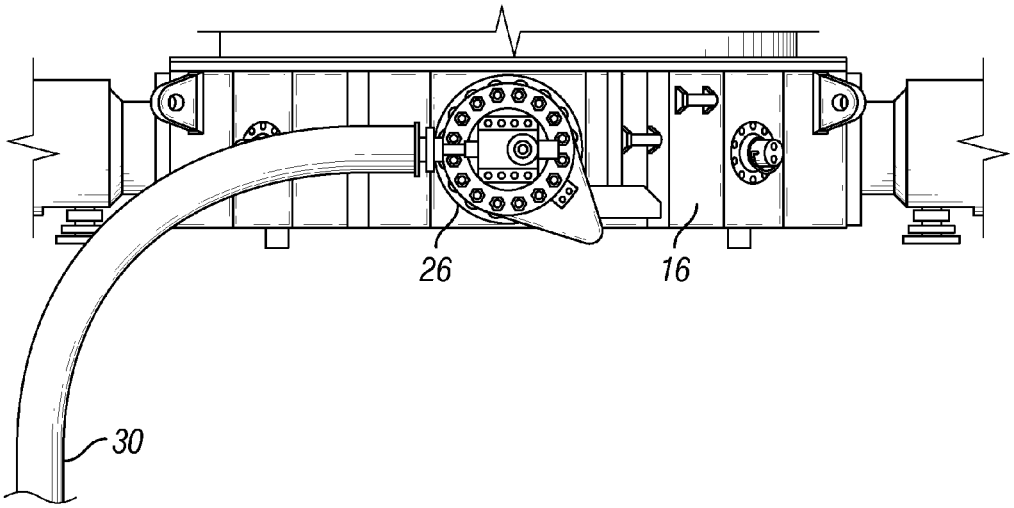

During certain operations it may be desirable to temporarily move the flexible hoses 30 out of the moon pool to allow other equipment to pass into or through the area. To support this movement, one or more of the cartridge assemblies 26 include a flexible hose coupling 29 that is rotatable about the central axis of the stab 32 so that the connection between the flexible hose 30 and the cartridge assembly 26 can be rotated relative to the gooseneck assembly 16. As an example, FIGS. 3A and 3B illustrate a flexible hose 30 being rotated from an operational position (FIG. 3A) to a stored position (FIG. 3B). The bending radius of the flexible hose 30 will cause the hose to move substantially away from its original position as the cartridge assembly 26 is rotated. A variety of apparatus and systems may be used to rotate the cartridge assembly 26 and/or the flexible hose 30 between the operational and the stored positions. In certain embodiments, the flexible hose 30 may be fitted with a bend restrictor near the connection to the cartridge assembly 26 so as to maintain a desired bend radius.

Figure 4:
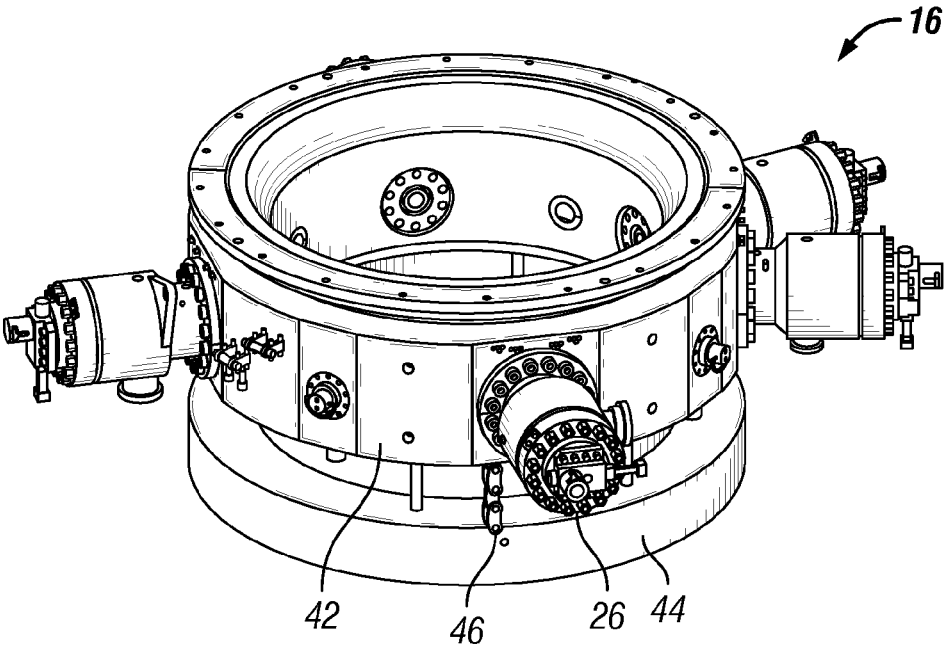
FIG. 4 is an isometric view of one embodiment of a hands free gooseneck assembly having rotatable cartridge assemblies.
Figure 5:
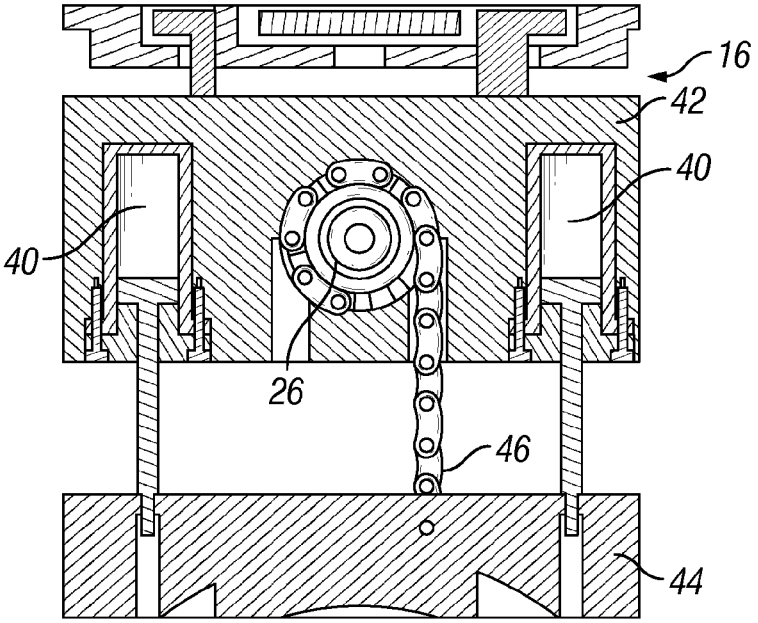
FIG. 5 is a partial sectional view of the hands free gooseneck assembly of FIG. 4.

Referring now to FIGS. 4 and 5, one embodiment of a hands free gooseneck assembly 16 includes one or more actuators 40 disposed within the assembly body 42. The actuators 40 may be hydraulic cylinders, electrical actuators, or some other linear actuator. The actuators 40 selectively extend and retract an actuating ring 44 that is connected to the cartridge assemblies 26 via a flexible linkage 46. The flexible linkage 46 may include chains, geared linkage, wire rope, fiber rope, or other flexible material that can transmit torque to the cartridge assembly 26. The flexible linkage 46 wraps at least partially around and engages the rotatable portion of the cartridge assembly 26. As the actuators 40 extend, the linkage 46 applies torque to the cartridge assembly 26, rotating it in either the clockwise or counter-clockwise direction, dependent on the linkage installation. Retracting the actuators 40 allows the cartridge assembly 26 to rotate back to its original position.

Figure 6A:
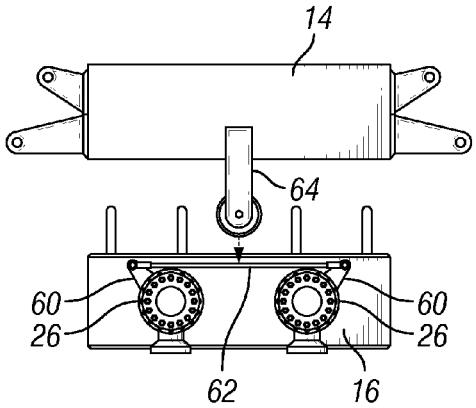
FIGS. 6A and 6B are partial elevation views of an alternative hands free gooseneck assembly having a rotatable coupling.
Figure 6B:
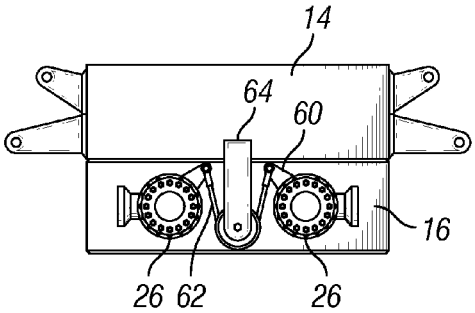
Figure 7A:
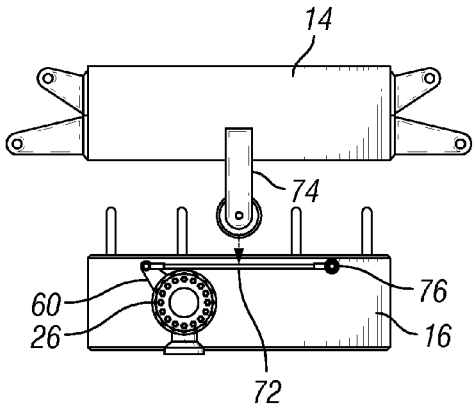
FIGS. 7A and 7B are partial elevation views of an alternative hands free gooseneck assembly having a rotatable coupling.
Figure 7B:
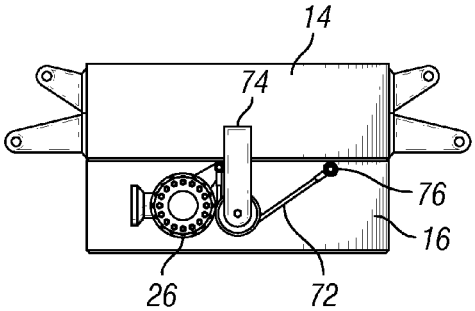

As shown in FIGS. 6A and 6B, in other embodiments, the rotating portion of the cartridge assemblies 26 may include an actuation arm 60 that extends radially from the coupling and is coupled to a flexible link 62. An actuation bar 64 extends from the tension ring 14 and is adapted to engage the flexible link 62 as the tension ring is moved toward the gooseneck assembly 16. The engagement of the actuation bar 64 and the flexible link 62 pulls the opposed actuation arms 60 toward each other and causes the cartridge assemblies 26 to rotate. In an alternative embodiment, as shown FIGS. 7A and 7B, the flexible link 72 is coupled to a single actuation bar 74 and to a fixed point 76 on the gooseneck assembly 16. The flexible links 62 and 72 may include chains, geared linkage, wire rope, fiber rope, or other flexible material that can transmit torque onto the cartridge assembly 26.

In operation, the hands free gooseneck 16 may be detached from the tension ring 14, lowered, and rotated such that the actuation arms 64, 74 are in line with the aforementioned linkages 62, 72. The hands free gooseneck 16 may then be raised back toward the tension ring 14 and locked in place. As previously discussed, the action of raising the hands free gooseneck 16 causes the actuation arms 64, 74 to engage the flexible links 62, 72 and rotate cartridge assemblies 26. The angle of rotation may be controlled by the length of the actuation arms 64, 74 and associated flexible links 62, 72. When the hands free gooseneck 16 is detached from the tension ring 14 and lowered again, the cartridge assemblies 26 rotate back to their initial position. For storage, the hands free gooseneck 16 may be rotated out of line with the actuation arms 64, 74, raised, and locked to the tension ring 14 for storage.

FIGS. 8A-B and 9A-B illustrate other alternative embodiments of a gooseneck assembly 16 where rotation of the cartridge assemblies 26 is accomplished through the use of a plurality of actuators 80. In the embodiments shown, the actuators 80 can be mounted to the gooseneck assembly 16, the tension ring 14, or the diverter 82. When the actuators 80 extend, it provides an input to an actuating lever 84 that protrudes radially from the cartridge assemblies 26. The direction and angularity of rotation depend on the placement of the actuating lever 84 and stroke of the actuators 80. The actuators 80 can then be retracted to rotate the cartridge assemblies 26 back to the initial position.

Figure 8A:
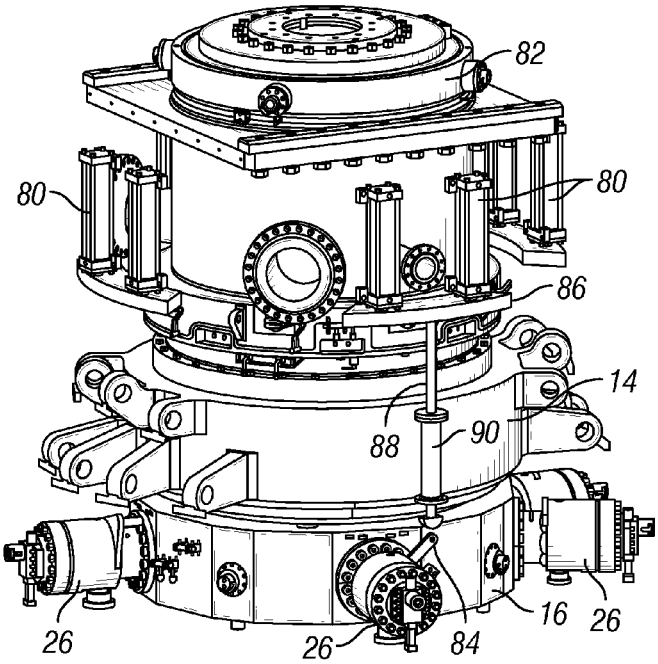
FIGS. 8A and 8B are partial elevation views of an alternative hands free gooseneck assembly having a rotatable coupling.
Figure 8B:
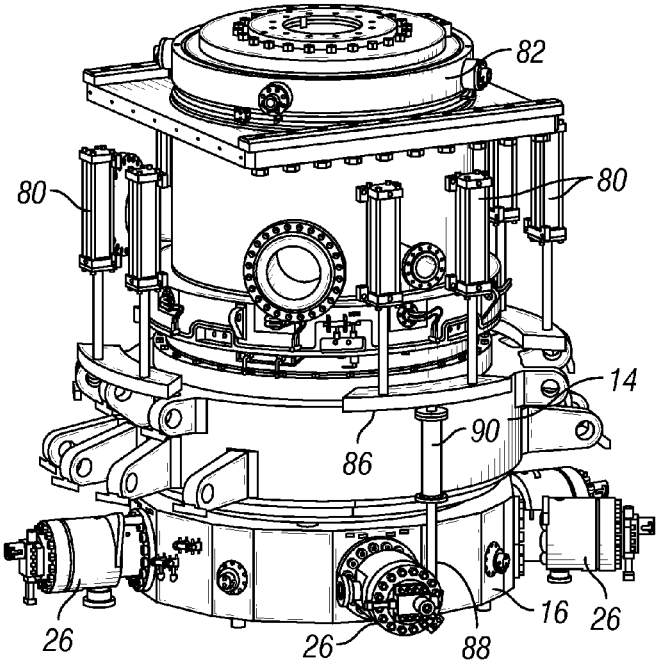

In FIGS. 8A and 8B, a pair of actuators 80 are coupled to the diverter 82 and engage a push bar 86 that is coupled to an upper end of a push rod 88. An intermediate cylinder 90 may be coupled to the tension ring 14 and provide further actuation force. The push rod 88 and/or intermediate cylinder 90 are coupled to an actuating lever 84 of a cartridge assembly 26. As the actuators 80 extend from the operating position shown in FIG. 8A, the cartridge assembly 26 will rotate to the position shown in FIG. 8B.

Figure 9A:
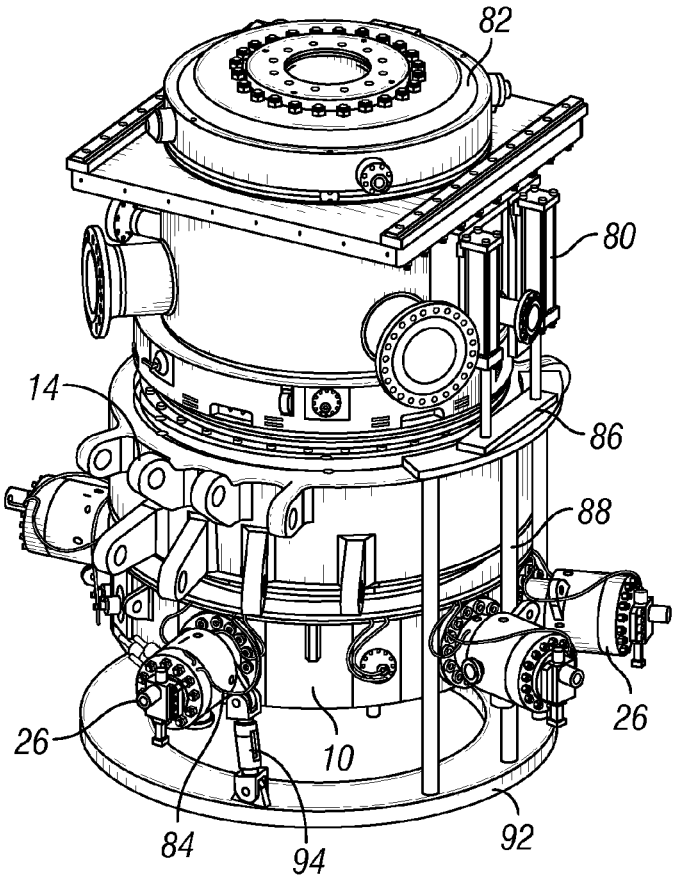
FIGS. 9A and 9B are partial elevation views of an alternative hands free gooseneck assembly having a rotatable coupling.
Figure 9B:
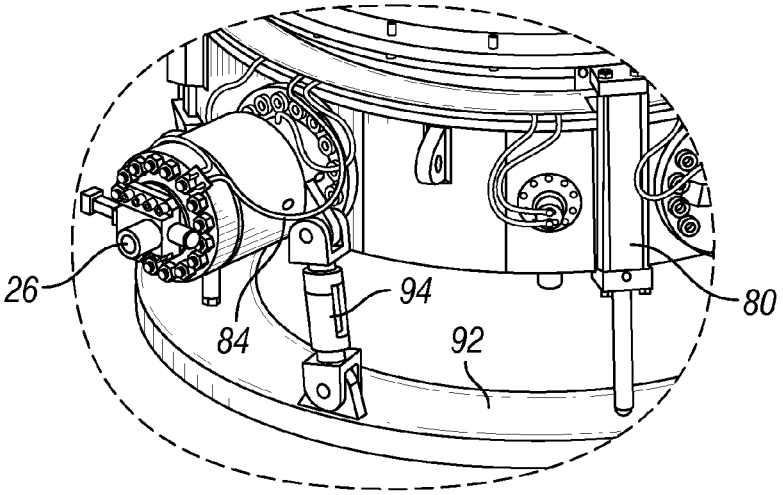

FIGS. 9A and 9B illustrate an alternative embodiment wherein actuators 80 move an actuation ring 92 that is coupled to one or more cartridge assemblies 26 via a secondary linkage 94. The secondary linkage 94 is coupled to an actuating lever 84 that radially projects from the cartridge assembly 26. The actuators 80 may be mounted to the diverter 82 (as shown in FIG. 9A), to the gooseneck assembly 16 (as shown in FIG. 9B), or to the tension ring 14. As the cylinder 80 extends, it moves the actuating ring 92 downward, causing the linkage 94 to pull the actuating lever 84 and rotate the cartridge assembly 26. The direction and angularity of rotation depend on the placement of the actuating lever 84 and stroke of the actuators 80. The actuators 80 can be retracted to rotate the cartridge assembly 26 rotate back to its initial position.

In certain embodiments, a hydraulic cylinder, or other linear actuator, can be directly attached to a lever arm located on a cartridge assembly. The hydraulic cylinder can be attached to a fixed point on the hands free gooseneck assembly so that rotation of the cartridge assembly is accomplished by extending and retracting the cylinder, imparting a rotation determined by the stroke of the attached cylinder. The cartridge assembly may be rotated in either the clockwise or counter clockwise direction determined by location of the anchor point and configuration of the hydraulic cylinder.

In other embodiments, a cartridge assembly can include gear teeth that enable rotation of the cartridge assembly. The gear teeth can engage a rack other gears that can be actuated to impart a torque onto the cartridge assembly. A rack may be coupled to the geared cartridge assembly and actuated by a linear actuator. In other embodiments, rotary actuators can be used to directly engage and rotate the geared cartridge assembly or may be coupled to the geared cartridge assembly via one or more intermediary gears.

Figure 10A:
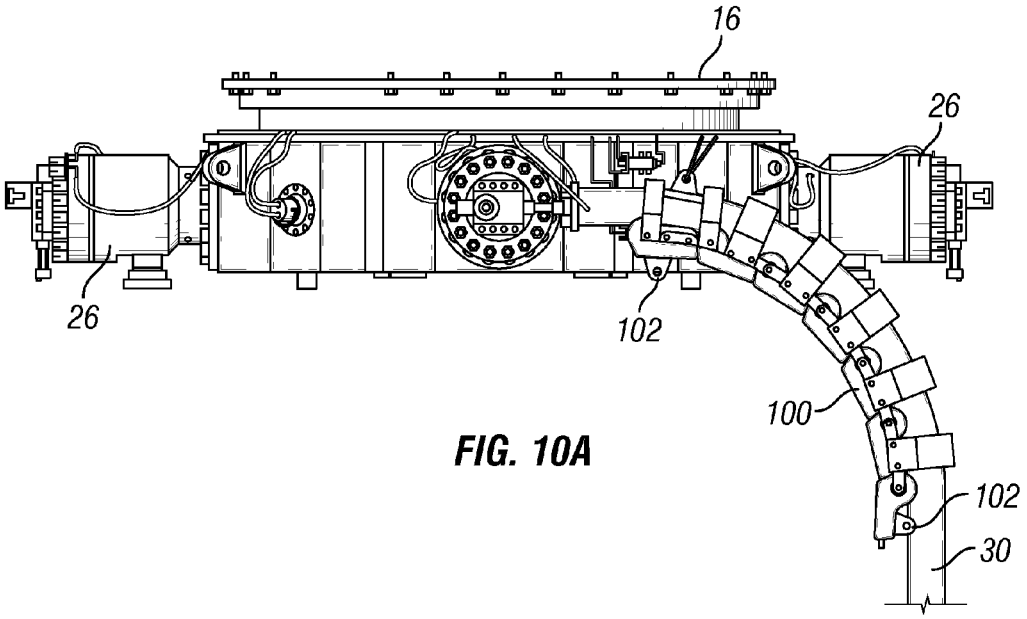
FIGS. 10A and 10B are partial elevation views of an alternative hands free gooseneck assembly having a rotatable coupling.
Figure 10B:
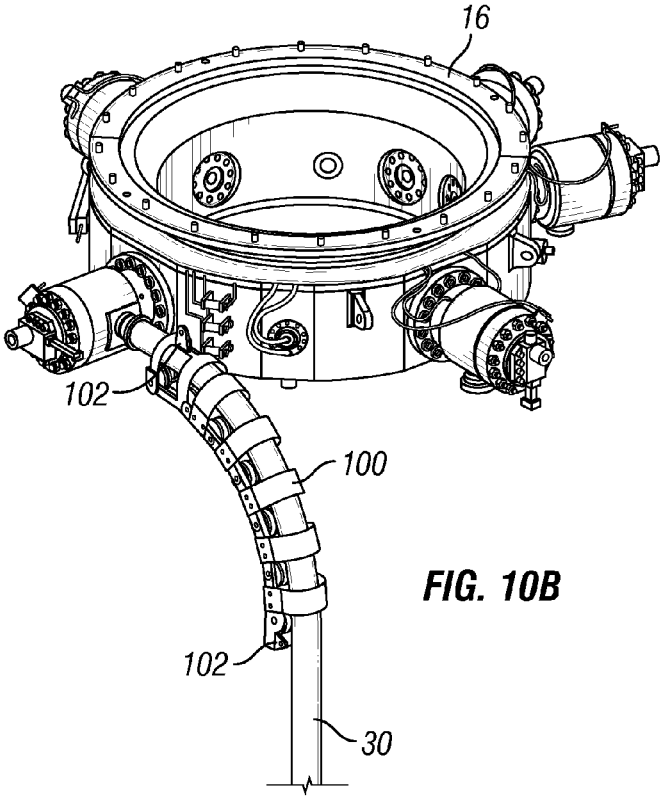

In certain embodiments, the use of separate actuators and systems may not be desired and the cartridge assemblies, and their attached flexible hoses, can be rotated via other means. For example, as shown in FIGS. 10A and 10B, a multi-hinged mechanism 100 can be coupled to the flexible hose 30 to enable engagement with a tugger line or other pulling system available on the rig. The multi-hinged mechanism 100 conforms to the natural bend radius of the flexible hose 30 and is equipped with multiple pulling points 102. The mechanism 100 can be stored on one end of the flexible line 30 while not in use. When needed, the mechanism 100 can be pulled along the flexible hose 30 to a desired location. Utilizing one or more of the pull points 102, the cartridge assembly can then be rotated in a desired direction depending on the direction of pull.

Rotation of a cartridge assembly can also be accomplished through stationary push bars mounted to the underside of the tension ring. The hands free gooseneck assembly can be detached from the tension ring and rotated by utilizing the top drive or other mechanism. As the gooseneck assembly rotates, the push bars react against and move the flexible hoses. The cartridge assemblies rotate as the flexible hoses are moved. Once the hoses are in the desired location, the hands free gooseneck assembly can then be raised back up to the tension ring and locked into place so that the flexible hoses remain in the desired position. In other embodiments, the cartridge assemblies can be equipped with extendable reaction bars which protrude into well center. A tool could be lowered through well center to engage the reaction bars and rotate the cartridge assemblies using either rotation or axial movement of the tool.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A gooseneck assembly comprising:

a body operable to be disposed circumferentially about a portion of a riser string;

a stab member that is inwardly radially extendable relative to the body so as to engage a receptacle disposed on the riser string;

a cartridge assembly engaged with the stab member and having a flexible hose coupling that is rotatable relative to a central axis of the stab member, wherein the coupling is in fluid communication with the receptacle via the stab member;

a flexible hose having an end coupled to the flexible hose coupling; and an actuator operable to rotate the flexible hose coupling relative to the central axis of the stab member from an operational position wherein the flexible hose extends vertically downward from the flexible hose coupling to a stored position wherein the end of the flexible hose that is coupled to the flexible hose coupling is at an angle to vertical.

2. The gooseneck assembly of claim 1, further comprising:

an actuating ring coupled to the actuator;

a flexible linkage that wraps at least partially around the cartridge assembly and is coupled to the actuating ring.

3. The gooseneck assembly of claim 1, further comprising:

an actuation arm extending from the cartridge assembly;

a flexible link coupled to the actuation arm; and an actuation bar coupled to the actuator and operable to engage the flexible link.

4. The gooseneck assembly of claim 3, wherein the flexible link is coupled to a second cartridge assembly.

5. The gooseneck assembly of claim 3, wherein the flexible link is coupled to the body.

6. The gooseneck assembly of claim 1, further comprising:

an actuation arm extending from the cartridge assembly, wherein the actuator is coupled to the actuation arm and the body.

7. The gooseneck assembly of claim 1, further comprising:

an actuation arm extending from the cartridge assembly; and an actuation ring coupled to the actuator and to the actuation arm, wherein the actuator is coupled to the body.

8. A gooseneck assembly comprising:

a body operable to be disposed circumferentially about a portion of a riser string;

a cartridge assembly rotatably coupled to the body;

a stab member engaged with the cartridge assembly and inwardly radially extendable relative to the body so as to engage a receptacle disposed on the riser string;

a flexible hose coupling disposed on the cartridge assembly and in fluid communication with the receptacle via the stab member;

a flexible hose having an end coupled to the flexible hose coupling; and an actuator coupled to the cartridge assembly and operable to rotate the cartridge assembly relative to a central axis of the stab member from an operational position, wherein the flexible hose extends vertically downward from the flexible hose coupling, to a stored position wherein the end of the flexible hose that is coupled to the flexible hose coupling is at an angle to vertical.

9. The gooseneck assembly of claim 8, further comprising:

an actuating ring coupled to the actuator; and a flexible linkage that wraps at least partially around the cartridge assembly and is coupled to the actuating ring.

10. The gooseneck assembly of claim 8, further comprising:

an actuation arm extending from the cartridge assembly;

a flexible link coupled to the actuation arm; and an actuation bar coupled to the actuator and operable to engage the flexible link.

11. The gooseneck assembly of claim 10, wherein the flexible link is coupled to a second cartridge assembly.

12. The gooseneck assembly of claim 10, wherein the flexible link is coupled to the body.

13. The gooseneck assembly of claim 8, further comprising:

an actuation arm extending from the cartridge assembly, wherein the actuator is coupled to the actuation arm and the body.

14. The gooseneck assembly of claim 8, flirther comprising:

an actuation arm extending from the cartridge assembly; and an actuation ring coupled to the actuator and to the actuation arm, wherein the actuator is coupled to the body.

15. A method comprising:

coupling an end of a flexible hose to a cartridge assembly that is coupled to a body that is disposable circumferentially about a portion of a riser string;

engaging a receptacle disposed on the riser string with a stab member that is engaged with the cartridge assembly; and rotating the cartridge assembly about a central axis of the stab member from an operational position, wherein the flexible hose extends vertically downward from the cartridge assembly, to a stored position, wherein the end of the flexible hose that is coupled to the cartridge assembly is at an angle to vertical.

16. The method of claim 15, wherein the cartridge assembly is rotated by applying tension to a flexible linkage that wraps at least partially around the cartridge assembly.

17. The method of claim 15, wherein a flexible link is coupled to an actuation arm that extends from the cartridge assembly and the cartridge assembly is rotated by engaging the flexible link with an actuation bar that applies tension to the flexible link.

18. The method of claim 17, wherein the flexible link is coupled to a second cartridge assembly and engaging the flexible link with the actuation bar also rotates the second cartridge assembly.

19. The method of claim 15, wherein the cartridge assembly is rotated by extending an actuator that is coupled to an actuation arm of the cartridge assembly.

20. The method of claim 15, wherein the cartridge assembly is rotated by extending an actuator to move an actuation ring that is coupled to an actuation arm of the cartridge assembly.

* * * * *